US005145420A

United States Patent [19]

Counsel et al.

[11] Patent Number: 5,145,420

[45] Date of Patent: Sep. 8, 1992

[54] ELECTRICAL WIRE CONNECTOR

[76] Inventors: Eugene F. Counsel, 2946 Deer Run S., Clearwater, Fla. 34621; Gino Menechella, 1 Topham Crescent, Richmond Hill, Ontario L4C 9G2, Canada

[21] Appl. No.: 708,406

[22] Filed: May 31, 1991

[51] Int. Cl.[5] ..... H01R 4/50

[52] U.S. Cl. ..... 439/783; 439/863

[58] Field of Search ..... 439/783, 790, 863

[56] References Cited

U.S. PATENT DOCUMENTS

| | | | |
|---|---|---|---|
| 1,801,277 | 5/1926 | Kelley | 439/783 |
| 2,106,724 | 2/1938 | Cope | 173/273 |
| 3,275,974 | 9/1966 | Mixon, Jr. | 439/783 |
| 3,349,167 | 10/1964 | Mixon, Jr. et al. | 174/94 |
| 4,279,461 | 7/1981 | Bussen et al. | 339/246 |
| 4,415,222 | 11/1983 | Polidori | 339/270 R |
| 4,600,264 | 7/1986 | Counsel | 339/247 |
| 5,006,081 | 4/1991 | Counsel et al. | 439/783 |
| 5,044,996 | 9/1991 | Goto | 439/783 |

*Primary Examiner*—Paula A. Bradley

*Attorney, Agent, or Firm*—Anton P. Ness; Bruce J. Wolstoncroft

[57] ABSTRACT

An electrical wire connector of the type having a wedge with converging side surfaces forcible into a C-shaped member between converging ears thereof, includes concave channel portions of the wedge side surfaces opposing arcuate inner surfaces of the ears to clamp respective wires therein under substantial clamping force to common and mechanically join them. The wedge has a raised region to be adjacent and abut the bight of the C-shaped member to minimize bowing thereof and thereby substantially increase the clamping force applied on the wires by the ears of the C-shaped member.

4 Claims, 3 Drawing Sheets

ELECTRICAL WIRE CONNECTOR

FIELD OF THE INVENTION

The present relates to the field of electrical connectors and more particularly to electrical connectors commoning and mechanically securing two electrical wires.

BACKGROUND OF THE INVENTION

Electrical connectors of the type having a C-shaped body member having converging channels and a complementary wedge member have been known conventionally for many years and are disclosed for example in U.S. Pat. No. 1,801,277 and in U.S. Pat. Nos. 4,415,222; 4,600,264; and 5,006,081. Basically, two uninsulated conductors are electrically and mechanically connected by being pressed into and against interior curved surfaces or channels provided in a C-shaped body member by a wedge being driven longitudinally into the body member between the conductors. These known wedge connectors have been successfully used in the power utility industry for large diameter cable where the C-members are massive enough to exert a resilient, compressive force against the cables trapped in the channels by the wedge.

In recently issued U.S. Pat. No. 5,006,081 such a C-shaped wedge connector is disclosed for use with somewhat smaller diameter wire, and in one embodiment the wedge is stamped and formed from sheet metal such as brass while in another the wedge is solid. The wedge is forced into the C-shaped member until stopped by a tab to prevent overtravel, and the wedge is retained in place in the C-shaped member applying continuous strong clamping force outwardly against the wires, pressing them tightly against the inner arcuate channels of the C-shaped member. With the stamped and formed wedge the retention is by means of a small rearwardly facing edge of a ramplike projection extending either outwardly from the wedge and into a slot in the bight of the C-shaped member, or inwardly from the C-shaped member into a slot of the wedge; and in the solid wedge embodiment the wedge includes a roll pin extending through a hole thereof for an end to project outwardly toward the bight of the C-shaped member to be received into a slot, with the slot preceded by a slight incline or taper to facilitate the roll pin passing over a portion of the C-shaped member to enter the slot.

It is desired to provide a C-shaped wedge connector which can generate higher clamping pressure against wires connected therein, while retaining the basic principles of the wedge forced into a C-shaped member.

SUMMARY OF THE INVENTION

The present invention provides a solid wedge for use with a C-shaped member, where the wedge includes arcuate channels along its lateral edges from front to back to receive wires therealong and press them against larger inner arcuate surfaces defined by the C-shaped member. The wedge includes a raised land along and across most of its top surface adjacent the bight of the C-shaped member which engages and bears against the inner surface of the bight to prevent bowing of the bight as the wedge drives the wires outwardly against the channels of the C-shaped member. Prevention of the bowing of the C-shaped member increases substantially the amount of compressive force generated against the wires by resisting the outward deflection of the ears of the C-shaped member which define the outer limits of the wire channels.

DETAILED DESCRIPTION OF THE PREFERRED EMBODIMENT

Figure 1:
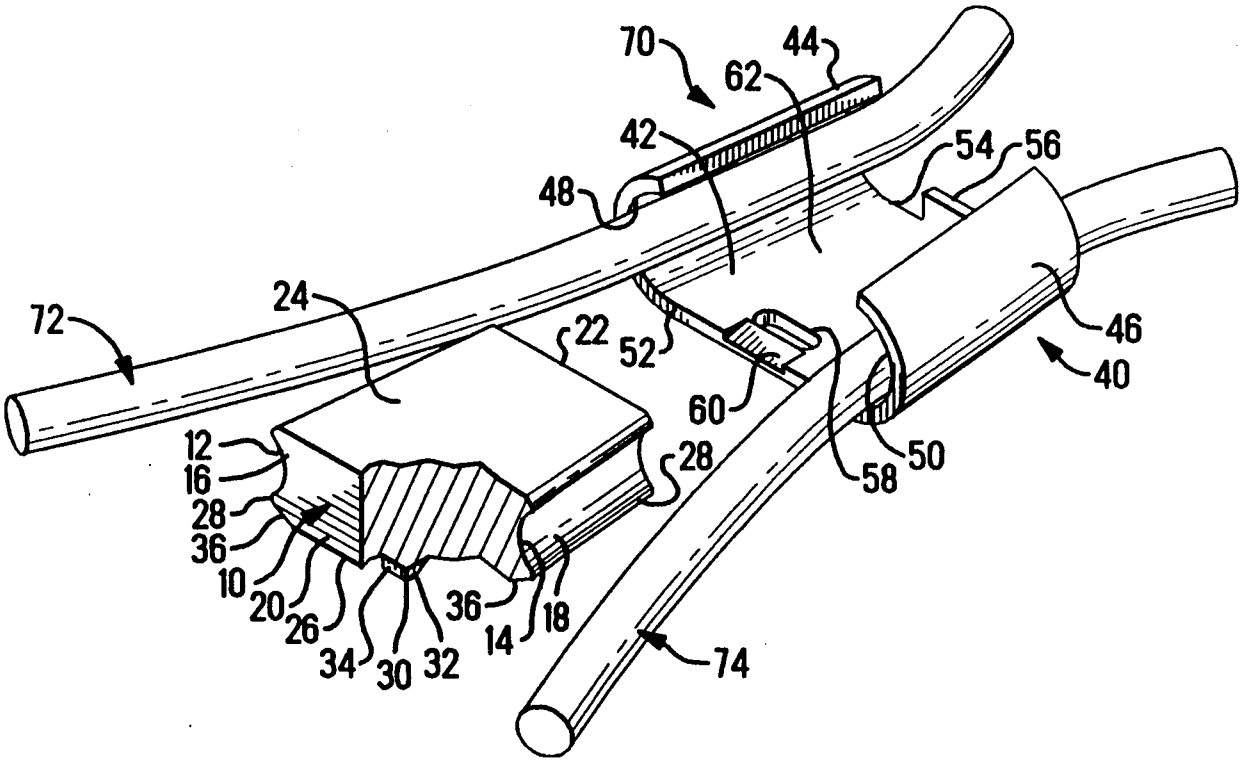
FIG. 1 is an isometric view of a wedge of the present invention exploded from a C-shaped member, with wires to be interconnected disposed in the channels.
Figure 2:
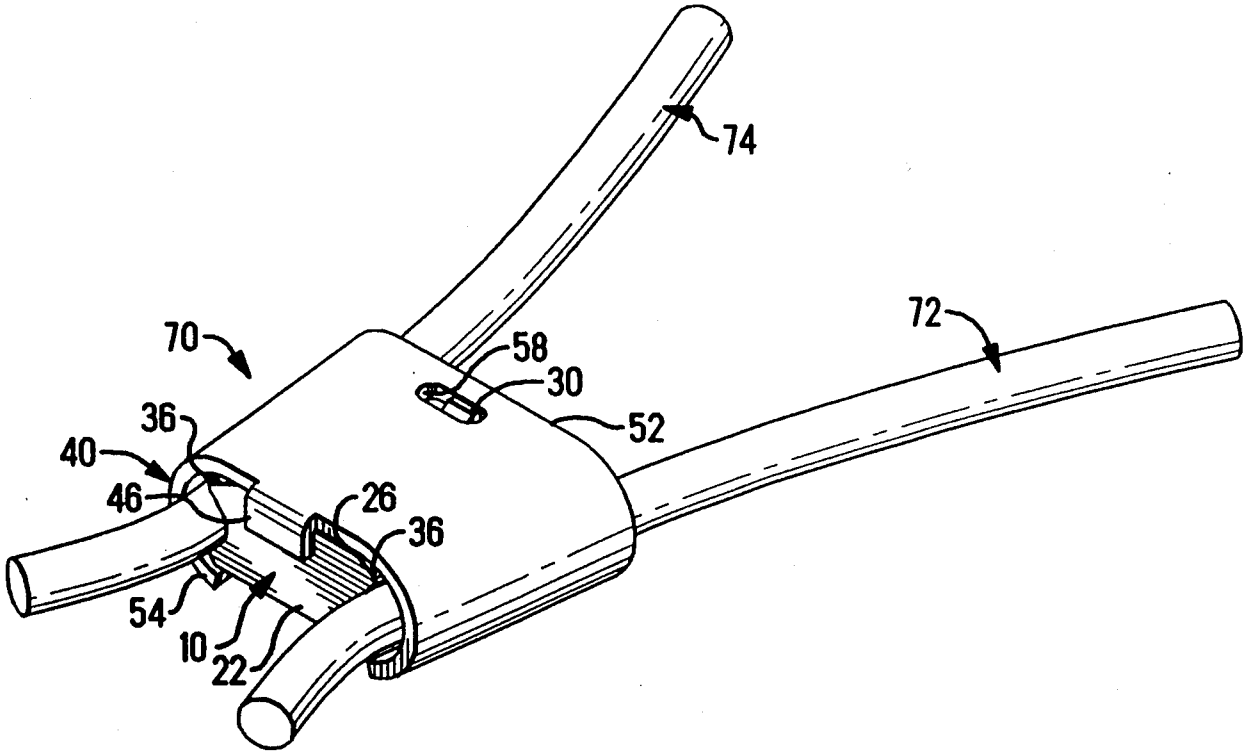
FIG. 2 is an isometric view of the connector of FIG. 1 fully applied to the wires viewed from the opposite end and inverted.
Figure 3:
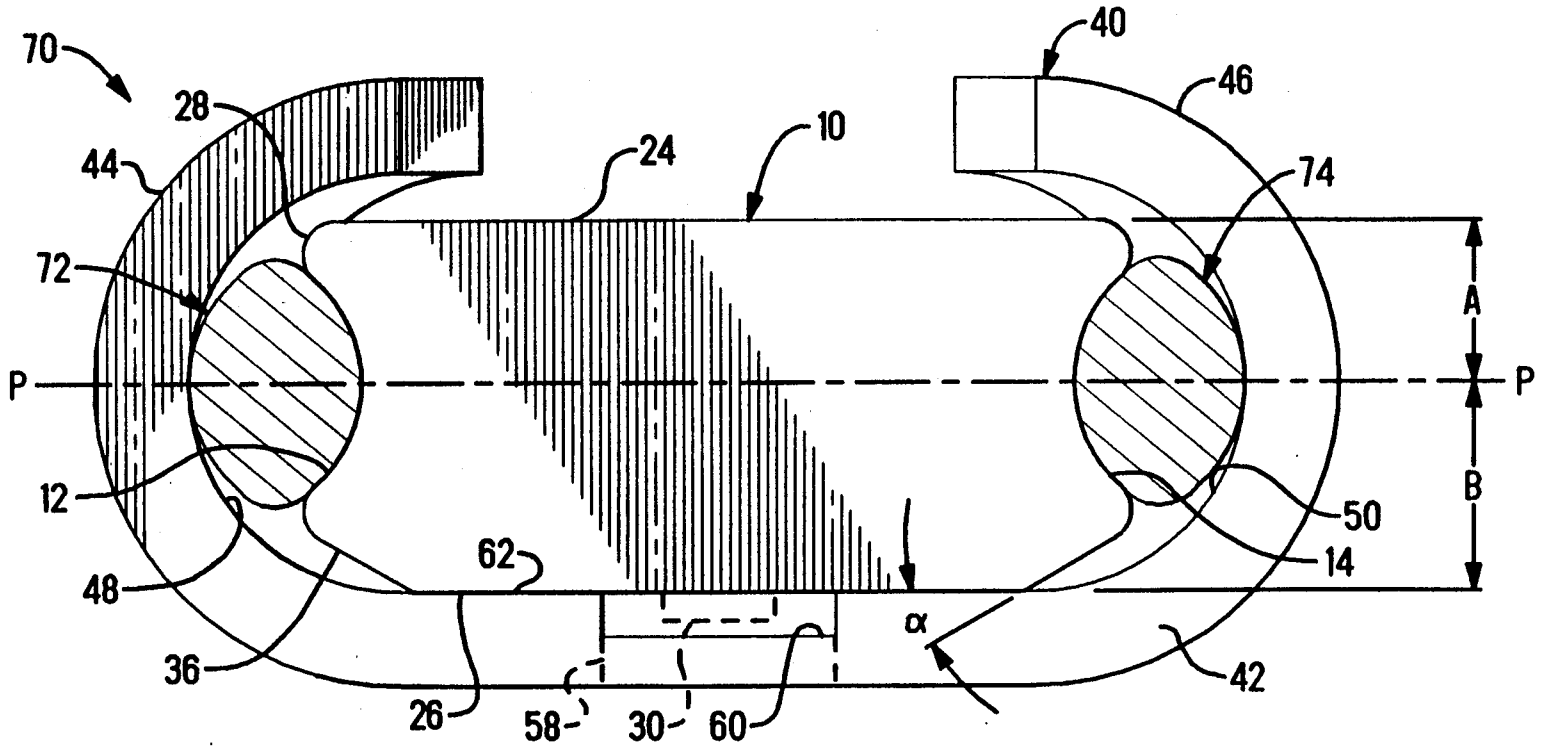
FIG. 3 is an end view of the applied connector illustrating the functioning of the improved wedge.

FIGS. 1 to 3 illustrate wedge member 10 of the present invention used with a C-shaped member 40 to define an electrical connector 70 to connect uninsulated wires 72,74. C-shaped member 40 includes a bight section 42 extending to opposed ears 44,46 having arcuate inner surfaces 48,50 defining outer peripheries of wire channels, and decreasing linearly in width from forward end 52 to rearward end 54. Rearward end 54 includes a stop tab 56, and forward end 52 includes a closed slot 58 preceded by a tapered lead-in surface 60 defined along inner bight surface 62. C-shaped member may be formed for example of stamped and formed brass, 0.100 inches thick.

Wedge member 10 is formed for example of solid high copper content alloy (80% min) and tin plated, to have concave channel sections 12,14 formed along side surfaces 16,18 extending from forward end 20 to rearward end 22, and decreasing linearly in width from forward end 20 to rearward end 22. Wedge member 10 also includes a top or bight-remote surface 24 and a bottom or bight-proximate surface 26, and intersections of top surface 24 with side surfaces 16,18 are radiused at 28 to generally coincide with inner surfaces 48,50 opposed therefrom when connector 70 is assembled. Locking wedge projection 30 is located on bottom surface 26 proximate forward end 20 and includes rearwardly facing beveled surface 32 and forwardly facing perpendicular surface 34, defining a lock mechanism when received into slot 58 upon full wedge insertion to lock wedge member 10 within C-shaped member 40, after riding over tapered lead-in surface 60 extending to slot 58. The intersections of bottom surface 26 with side surfaces 16,18 are radiused adjacent the arcuate surfaces of channels 12,14 but beveled at 36 with the result that the plane P of the centerlines of the channels 12,14 is closer to top or bight-remote wedge surface 24 (distance A) than to bottom or bight-proximate surface 26 (distance B), or in other words, bottom surface 26 is raised. More importantly, bight-proximate surface 26 extends outwardly a distance equal to the distance between the inner bight surface 62 and the plane P coincident between the centerlines of arcuate surfaces 48,50 which is also coincidental with the centerline plane for wedge member 10 upon assembly, as the wires being connected react to center the wedge within the C-shaped member.

Preferably, the angle $\alpha$ of bevel for intersections 36 is about 30° but can be varied between 20° and 40°, until bottom surface 26 is raised about 30% in distance from the centerline plane P than the distance from the plane to top surface 24, but can be varied between 25% and 35% as desired. The incremental resultant height of bottom surface 26 has significant impact in preventing bowing or concave deflection of bight section 52 of C-shaped member 50, maintaining greater resistance to outward deflection of ears 44,46 and as a result enabling greater clamping force to be applied to wires 72,74 by connector 70.

Variations and modifications may be made to the wedge of the present connector disclosed in the present embodiment, consistent with the minimizing of bowing of the bight section of the C-shaped member. One modification could comprise placing the locking projection on the inside surface of the bight section of the C-shaped member, to lock within an appropriately shaped recess or slot along the bottom or bight-proximate surface of the wedge. Such modifications are within the spirit of the invention and the scope of the claims.

What is claimed is:

1. An improved electrical wire connector for electrically commoning and mechanically securing a pair of electrical wires, of the type utilizing a C-shaped member having a bight section extending to opposing arcuate ears along lateral edges defining outer boundaries of wire channels and converging from a forward end to a rearward end, and a wedge forceable between the ears and converging from a forward end to a rearward end and having concave side surfaces opposed from inner surfaces of the ears defining inner boundaries of the wire channels, for wires to be disposed along respective ones of the wire channels and be clamped and commoned upon the forcing of the wedge into the C-shaped member and between the wires, and locked in place, the improvement comprising:

said wedge being solid and having a bight-remote surface and a bight-proximate surface, the bight-proximate surface extends outwardly from a plane extending between the centerlines of the concave side surfaces substantially to the same extent as the inner surface of the bight section of the C-shaped member extends from the plane between the centerlines of the arcuate ears thereof, the bight-proximate surface is spaced from the plane extending between the centerlines of the concave side surfaces a greater distance than the bight-remote surface, whereby said bight-proximate wedge surface is closely adjacent said inner surface of said bight section when being forced into said C-shaped member during application to said two wires and minimizes bowing inwardly of said bight section under stress and allows greater compressive force against the wires to be attained by the connector.

2. The improved electrical wire connector as set forth in claim 1 wherein said bight-proximate surface includes beveled portions laterally therealong intersection said side surfaces of said wedge.

3. The improved electrical wire connector as set forth in claim 2 wherein said beveled intersection surface portions are disposed at an angle of from 20° to about 40°.

4. The improved electrical wire connector as set forth in claim 3 wherein said beveled intersection surface portions are disposed at an angle of about 30°.

* * * * *